US010435977B2

(12) United States Patent
Sommer

(10) Patent No.: US 10,435,977 B2
(45) Date of Patent: Oct. 8, 2019

(54) DOWNHOLE STROKING TOOL

(71) Applicant: WELLTEC A/S, Allerød (DK)

(72) Inventor: Rasmus Sommer, Allerød (DK)

(73) Assignee: Welltec A/S, Allerød (DK)

( * ) Notice: Subject to any disclaimer, the term of this patent is extended or adjusted under 35 U.S.C. 154(b) by 150 days.

(21) Appl. No.: 15/552,579

(22) PCT Filed: Mar. 2, 2016

(86) PCT No.: PCT/EP2016/054452
§ 371 (c)(1),
(2) Date: Aug. 22, 2017

(87) PCT Pub. No.: WO2016/139264
PCT Pub. Date: Sep. 9, 2016

(65) Prior Publication Data

US 2018/0030797 A1 Feb. 1, 2018

(30) Foreign Application Priority Data

Mar. 3, 2015 (EP) ..... 15157462
Mar. 20, 2015 (EP) ..... 15160029
Jun. 29, 2015 (EP) ..... 15174393

(51) Int. Cl.
*E21B 31/113* (2006.01)
*E21B 23/04* (2006.01)
(Continued)

(52) U.S. Cl.
CPC ..... *E21B 31/113* (2013.01); *E21B 4/06* (2013.01); *E21B 4/12* (2013.01); *E21B 4/14* (2013.01);
(Continued)

(58) Field of Classification Search
CPC ..... E21B 31/113; E21B 23/01; E21B 4/12; E21B 4/06; E21B 23/14; E21B 4/14;
(Continued)

(56) References Cited

U.S. PATENT DOCUMENTS 2,937,007 A 5/1960 Whittle
3,138,214 A 6/1964 Bridwell
(Continued)

FOREIGN PATENT DOCUMENTS

CN 101680277 A 3/2010
CN 103797212 A 5/2014
(Continued)

OTHER PUBLICATIONS

International Search Report for PCT/EP2016/054452 dated Jun. 7, 2016, 11 pages.
(Continued)

*Primary Examiner* — Michael R Wills, III
(74) *Attorney, Agent, or Firm* — Nixon & Vanderhye P.C.

(57) ABSTRACT

A downhole stroking tool (1) comprising a housing (2), a first chamber (3), a first tool part (4) comprising a pump unit (5) providing pressurized fluid to the chamber, a shaft (6) penetrating the chamber, and a first piston (7) dividing the first chamber into a first chamber section (8, 8*a*) and a second chamber section (9, 9*b*). The piston is connected to or forms part of the housing which forms part of a second tool part (10) and is slidable in relation to the shaft so that the housing moves in relation to the shaft, the shaft being stationary in relation to the pump unit during pressurization of the first or the second chamber section, thereby generating a pressure on the piston, wherein the shaft is fixedly connected with the first tool part, and wherein the housing is slidable in relation to the first tool part and overlaps the first tool part.

18 Claims, 9 Drawing Sheets

(51) Int. Cl.

| | |
|---|---|
| ***E21B 23/00*** | (2006.01) |
| ***E21B 23/01*** | (2006.01) |
| ***E21B 4/14*** | (2006.01) |
| ***E21B 23/14*** | (2006.01) |
| ***E21B 4/06*** | (2006.01) |
| ***E21B 4/12*** | (2006.01) |
| *E21B 33/127* | (2006.01) |

(52) U.S. Cl.
CPC ..... *E21B 23/00* (2013.01); *E21B 23/01* (2013.01); *E21B 23/04* (2013.01); *E21B 23/14* (2013.01); *E21B 33/127* (2013.01); *E21B 2023/008* (2013.01)

(58) Field of Classification Search
CPC .. E21B 2023/008; E21B 33/127; E21B 23/03; E21B 23/06; E21B 23/00
See application file for complete search history.

(56) References Cited

U.S. PATENT DOCUMENTS 3,186,485 A * 6/1965 Owen ..... E21B 23/065 166/122
3,497,019 A 2/1970 Ortloff
8,171,988 B2 * 5/2012 Hallundbaek ..... E21B 23/04 166/66.4
2002/0157867 A1 10/2002 Moore
2013/0048271 A1 * 2/2013 VanLue ..... E21B 33/128 166/118
2014/0048288 A1 2/2014 Clemens et al.
2015/0247377 A1 * 9/2015 Williamson, Jr. ..... E21B 23/04 166/154
2016/0115753 A1 * 4/2016 Frazier ..... E21B 43/1185 166/53
2016/0168936 A1 * 6/2016 Carisella ..... E21B 23/04 166/381

FOREIGN PATENT DOCUMENTS

| | | |
|---|---|---|
| EP | 2 341 211 | 7/2011 |
| EP | 2 607 606 | 6/2013 |
| EP | 2 886 790 | 6/2015 |
| WO | WO 2008/128543 | 10/2008 |

OTHER PUBLICATIONS

Extended Search Report for EP15160029.3 dated Oct. 2, 2015, 5 pages.
Extended Search Report for EP15174393.7 dated Jan. 4, 2016, 8 pages.
Notification of the First Office Action dated Mar. 19, 2019 in Chinese Application No. 201680010647.X, with English translation, 11 pages.

* cited by examiner

DOWNHOLE STROKING TOOL

This application is the U.S. national phase of International Application No. PCT/EP2016/054452 filed Mar. 2, 2016 which designated the U.S. and claims priority to EP Patent Application No. 15157462.1 filed Mar. 3, 2015, EP Patent Application No. 15160029.3 filed Mar. 20, 2015 and EP Patent Application No. 15174393.7 filed Jun. 29, 2015, the entire contents of each of which are hereby incorporated by reference.

FIELD OF THE INVENTION

The present invention relates to a downhole stroking tool for providing an axial force in an axial direction, comprising a housing, a first chamber, a first tool part comprising a pump unit providing pressurised fluid to the chamber, a shaft penetrating the chamber, and a first piston dividing the first chamber into a first chamber section and a second chamber section. Furthermore, the invention relates to a downhole system comprising the downhole stroking tool and a driving unit, such as a downhole tractor, for propelling the system forward in a well, and to the use of a downhole stroking tool for pulling a plug in a well.

BACKGROUND ART

When operating in a well, a high axial force is sometimes needed to e.g. pull a plug, such as a bridge plug. However, the known tools are currently not designed to generate a sufficiently high amount of power to pull certain plugs or old plugs which are often stuck in the well due to precipitated scale on the plug.

SUMMARY OF THE INVENTION

It is an object of the present invention to wholly or partly overcome the above disadvantages and drawbacks of the prior art. More specifically, it is an object to provide an improved tool providing a higher axial force than the known tools to be able to pull all kinds of plugs.

The above objects, together with numerous other objects, advantages and features, which will become evident from the below description, are accomplished by a solution in accordance with the present invention by a downhole stroking tool for providing an axial force in an axial direction, comprising:

- a housing,
- a first chamber,
- a first tool part comprising a pump unit providing pressurised fluid to the chamber,
- a shaft penetrating the chamber, and
- a first piston dividing the first chamber into a first chamber section and a second chamber section, wherein the piston is connected to or forms part of the housing which forms part of a second tool part and is slidable in relation to the shaft so that the housing moves in relation to the shaft, the shaft being stationary in relation to the pump unit during pressurisation of the first or the second chamber section, generating a pressure on the piston, wherein the shaft is fixedly connected with the first tool part, and wherein the housing is slidable in relation to the first tool part and overlaps the first tool part.

By the shaft being fixed and by the housing being the piston sliding, the force generated by the downhole stroking tool is mainly transferred via the housing and not via the shaft to e.g. a plug as in prior art tools. By displacing the housing in relation to the fixated shaft and the fixated first tool part, a higher bending stiffness of the downhole stroking tool is obtained. The housing is supported along its stroke by the piston, whereby the downhole stroking tool is capable of transferring a higher axial force substantially without bending compared to prior art tools.

In an embodiment, the first chamber section and the second chamber section may be fluidly connected to the pump unit.

In this way, fluid from the pump unit can enter the first chamber section to move the housing away from the pump unit.

In another embodiment, the tool may further comprise a pressure intensifier arranged downstream of the pump unit to increase the pressure of a fluid before the fluid is fed to the chamber.

By having a pressure intensifier, the downhole stroking tool is capable of generating a higher fluid pressure than the pump unit, and thus, the downhole stroking tool is capable of providing a higher axial force than without the pressure intensifier. Due to the restrictions downhole in a well, the size of the pump unit is also restricted.

The shaft may have a through-bore for allowing an electrical conductive means to run through the shaft.

Furthermore, by the shaft being fixed and by the housing being the piston sliding, the shaft does not transfer any force during the stroke and can thus have several through-bores for fluid channels and for electrical wiring.

The downhole stroking tool may further comprise a connector configured to connect with an operational tool.

Furthermore, the housing may comprise a first end part overlapping the first tool part.

Hereby, the housing is stabilised during movement back and forth.

By having the housing overlapping the first tool part, an even higher bending stiffness of the downhole stroking tool is obtained, as the housing is also supported by the first tool part during a stroke.

Furthermore, the housing may comprise a second end part connected to the connector.

Also, the downhole stroking tool may further comprise an operational tool connected with the housing.

Moreover, the operational tool may be a fishing neck, a key tool or a setting tool.

Further, the operational tool may be electrically powered.

In an embodiment, the housing may have an inner diameter substantially corresponding to an outer diameter of the first tool part.

In addition, the housing may have an inner diameter substantially corresponding to an outer diameter of the first tool part along the first tool part which overlaps the housing.

Also, the shaft and/or the housing may comprise one or more fluid channels for providing fluid to and/or from the chamber during pressurisation of the first or the second chamber section, thereby generating a pressure on the piston.

In an embodiment, the first tool part may have at least one sealing element for providing a seal against the housing.

Furthermore, the tool may comprise a valve block for controlling which chamber section is fed the pressurised fluid and thus whether the downhole stroking tool provides an upstroke or downstroke movement.

Additionally, the housing may transfer the axial force.

The downhole stroking tool may further comprise a second chamber divided by a second piston.

Moreover, the second chamber may comprise a first chamber section and a second chamber section.

Also, the first and second chambers may be comprised in the housing.

In addition, the shaft may comprise an intermediate part separating or dividing the first and the second chamber.

The intermediate part may support the housing, allowing the housing to slide in relation to the intermediate part.

In an embodiment, the tool may be powered by a battery in the tool and thus be wireless.

Furthermore, the pump unit may be powered by high-pressured fluid from surface down through a pipe, coiled tubing or a casing.

The downhole stroking tool may further comprise an anchoring section having projectable fixation units for fixating the downhole stroking tool in a well.

In an embodiment, the anchoring section may be connected to the first tool part and be configured to anchor the first tool part in a well.

The present invention furthermore relates to a downhole system comprising the downhole stroking tool described above and a driving unit, such as a downhole tractor, for propelling the system forward in a well.

In addition, the present invention relates to a downhole system comprising the downhole stroking tool described above and a well tubular metal structure comprising an annular barrier for isolating a first zone from a second zone in an annulus surrounding the well tubular metal structure.

Furthermore, the annular barrier may comprise a tubular metal part mounted as part of the well tubular metal structure, and an expandable metal sleeve connected with the tubular metal part defining an expandable space. The annular barrier may comprise an expansion opening in the tubular metal part through which pressurised fluid enters to expand the expandable metal sleeve.

Also, the downhole stroking tool may comprise an expansion section having circumferential sealing elements arranged on each side of the expansion opening for isolating an expansion zone opposite the expansion opening.

In one embodiment, a tool end element may be connected with the expansion section, the tool end element comprising fluid channels providing fluid communication between the second chamber section and an opening in the expansion section opposite the expansion zone. This is to provide pressurised fluid into the expandable space and expand the annular barrier.

Furthermore, the fluid channel of the shaft of the downhole stroking tool may be fluidly connected with the sealing elements of the expansion section to expand the sealing elements by means of pressurised fluid from the pump unit.

In another embodiment, the second tool part, the housing and the piston of the downhole stroking tool are connected with a first end of a section shaft of the expansion section, and a second end of the section shaft may be connected to a piston sliding in a section housing, the piston dividing the section housing into a first chamber section and a second chamber section, the first chamber section being in fluid communication with an opening in the expansion section to provide pressurised fluid into the annular barrier.

In addition, the opening of the expansion section may be provided with a one-way valve or check valve.

Furthermore, the first section chamber may be fluidly connected with a part of an inside of the well tubular metal structure by means of a second fluid channel which part does not form part of the isolated zone.

Also, the second fluid channel may be provided with a one-way valve or check valve for taking in fluid from the well tubular metal structure.

Finally, the present invention relates to the use of a downhole stroking tool described above for pulling a plug in a well.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
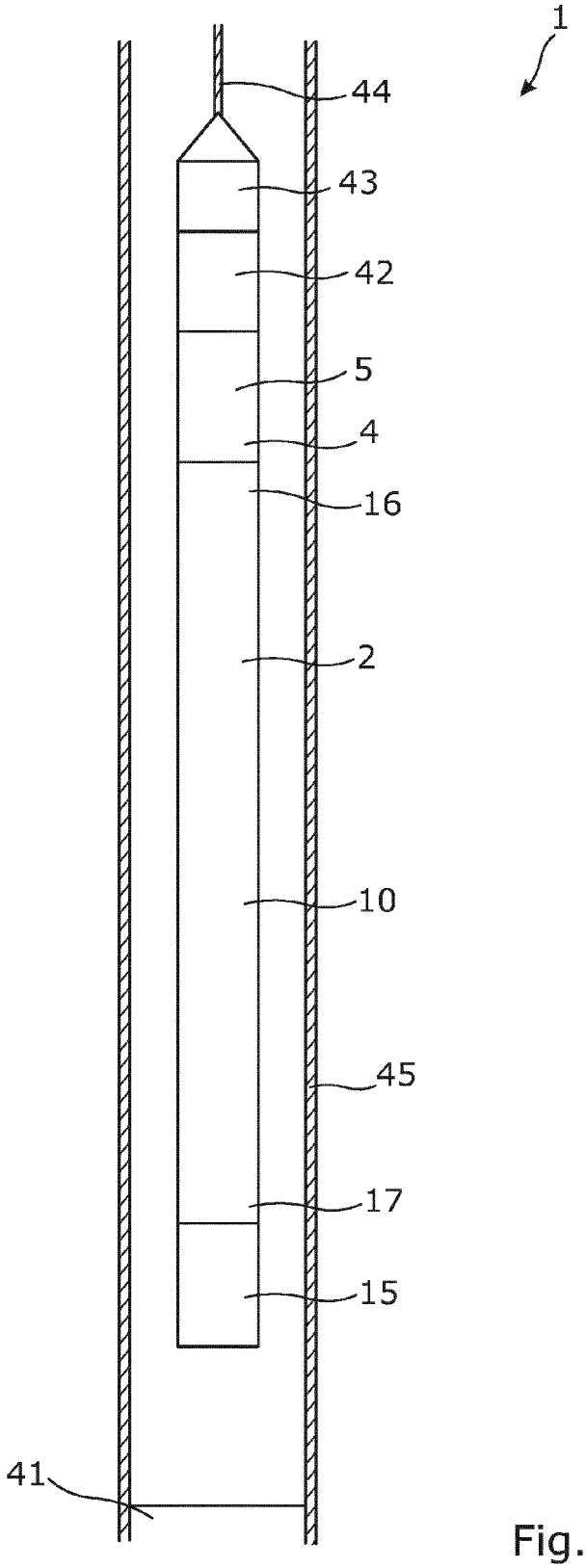
FIG. 1 shows a downhole stroking tool in a casing in a well.

FIG. 1 shows a downhole stroking tool 1 for providing an axial force in an axial direction of the tool, which is also the axial direction of a well, e.g. to pull a plug 41 and a casing 45. The downhole stroking tool 1 comprises a housing 2, a first chamber inside the tool, and a first tool part 4 comprising a pump unit 5 for providing pressurised fluid to the chamber. The downhole stroking tool 1 further comprises an electrical motor 42 and an electronic section 43 for controlling the function of the tool. The tool 1 is electrically powered through a wireline 44.

Figure 2:
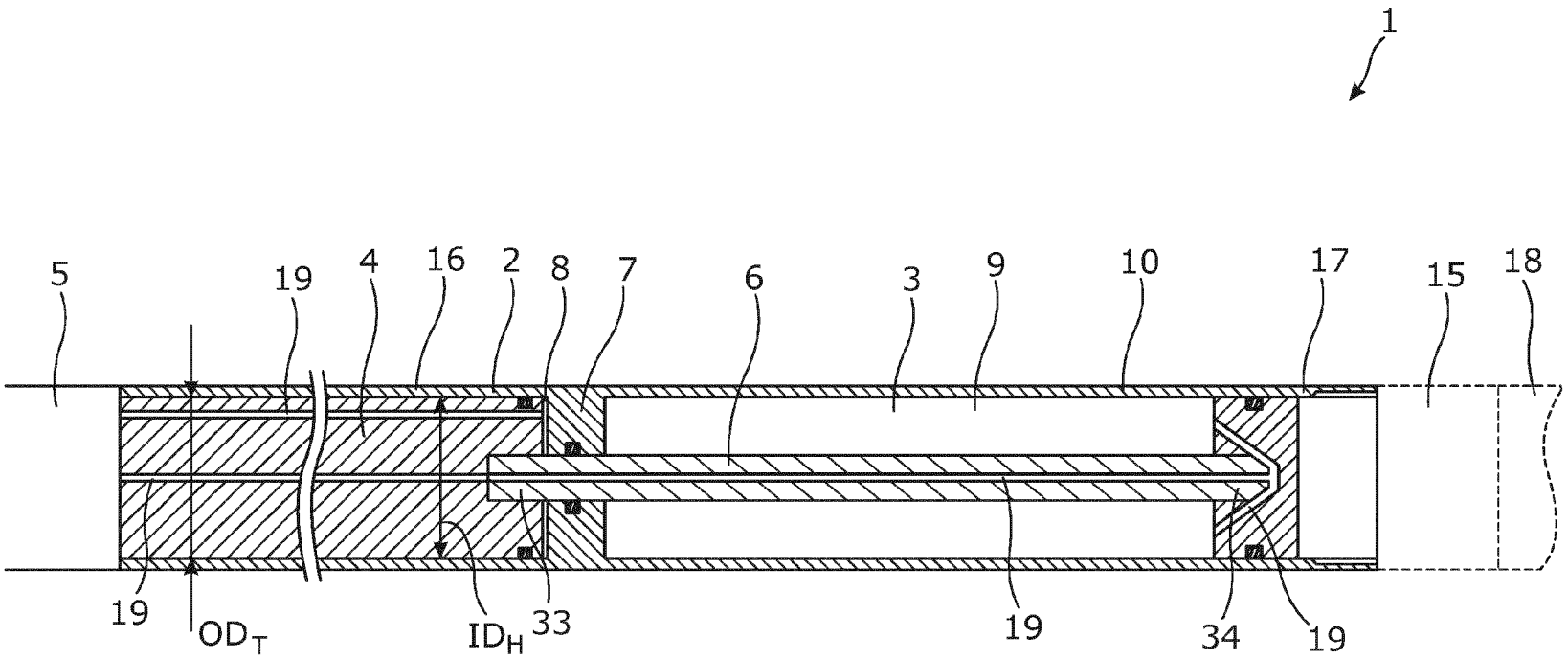
FIG. 2 shows a partly cross-sectional view of the downhole stroking tool in which the tool is in a fully upstroke position ready to provide a downstroke position.

In FIG. 2, the downhole stroking tool 1 comprises a shaft 6 penetrating the chamber 3 and a first piston 7 dividing the chamber into a first chamber section 8 and a second chamber section 9. The piston 7 forms part of the housing 2 which forms part of a second tool part 10. The second tool part 10, the housing 2 and the piston 7 are slidable in relation to the shaft 6 and the first tool part 4 so that the housing moves in relation to the shaft and the shaft is stationary in relation to the pump unit 5 during pressurisation of the first or the second chamber section 8, 9. The fluid is fed to one of the chamber sections 8, 9 through a fluid channel 19 in the first tool part 4 and a fluid channel 19 in the shaft 6 for providing fluid to and/or from the chamber 3 during pressurisation of the first or the second chamber section 8, 9, generating a pressure on the piston 7.

Figure 3:
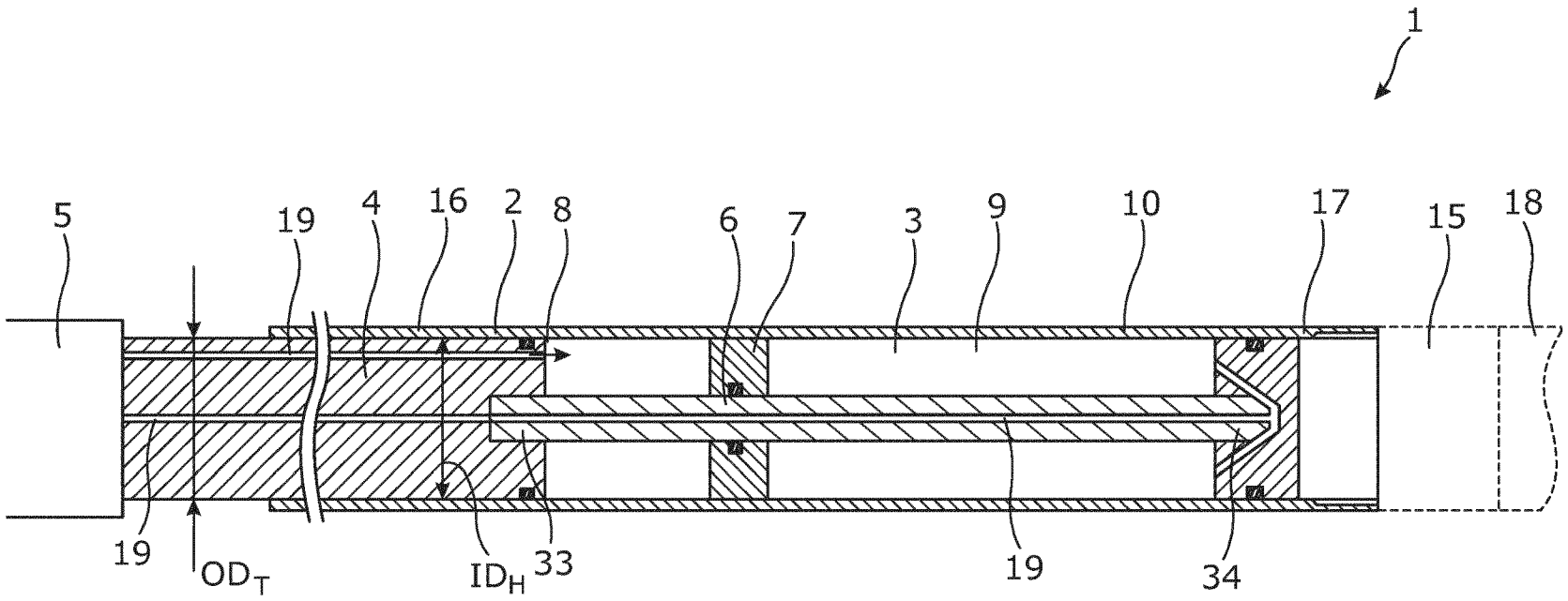
FIG. 3 shows a partly cross-sectional view of the downhole stroking tool of FIG. 2 in which the tool is performing a downstroke movement.

The pressurisation of the first chamber section 8 generates a pressure on the piston 7 and a downstroke movement in that the housing 2 moves down, away from the pump unit 5, as shown in FIG. 3. While fluid is led into the first chamber section 8, fluid is forced out of the second chamber section 9. When providing pressurised fluid into the second chamber section 9, a pressure is generated on the piston 7, providing an upstroke movement in that the housing 2 moves from the position shown in FIG. 3 to the position shown in FIG. 2 and thus moves towards the pump unit 5. The shaft 6 is fixedly connected with the first tool part 4, and the housing 2 is slidable in relation to the first tool part and a first end part 16 of the housing overlaps the first tool part. When overlapping, the housing 2 is supported partly by the first tool part 4, since the first tool part has an outer diameter $OD_T$ which is substantially the same as an inner diameter $ID_H$ of the housing. The housing 2 comprises a second end part 17 connected to a connector 15, illustrated by dotted lines. The connector 15 may furthermore be connected to an operational tool 18, also illustrated by dotted lines.

By the shaft 6 being fixed and the housing 2 with the piston being slidable, the force generated by the downhole stroking tool 1 is mainly transferred via the housing and not via the shaft to e.g. a plug as in prior art tools. When transferring a high force close to the centre of the tool 1 and when the tool is not fully aligned with the element it presses onto, the shaft 6 bends easier than when being aligned with the element. When transferring the high axial force mainly via the housing 2, the force is transferred further away from the centre and thus eliminates the risk of bending when being off the centre in relation to the element. The tool 1 of the present invention is therefore capable of transferring a higher amount of force as the risk of the shaft bending while transferring a high force is substantially decreased. In prior art tools transferring the generated axial force via a shaft, the shaft bends when the force exceeds a certain level. Increasing the shaft diameter reduces the area of the piston and thus reduces the force the piston is capable of providing. Prior art tools cannot provide a force substantially above 50,000 pounds, but the tool 1 of the present invention can provide a force of 100,000 pounds. Furthermore, by moving the housing 2 in relation to the stationary shaft 6 and the stationary first tool part 4, a higher bending stiffness of the downhole stroking tool is obtained. The housing 2 is supported along its stroke by the piston 7, whereby the downhole stroking tool 1 is capable of transferring a higher axial force substantially without bending compared to prior art tools.

Furthermore, by the shaft 6 being fixed and the housing 2 with the piston sliding, the shaft does not transfer any force and thus does not have to have a certain diameter, and the shaft diameter can therefore be reduced and the piston area increased, enabling the tool 1 to generate a higher axial force.

In another embodiment, the tool 1 is powered by a battery in the tool and is thus wireless. In another, not shown, embodiment, the pump unit may be powered by high-pressured fluid from surface down through a pipe, coiled tubing or casing.

Figure 4:
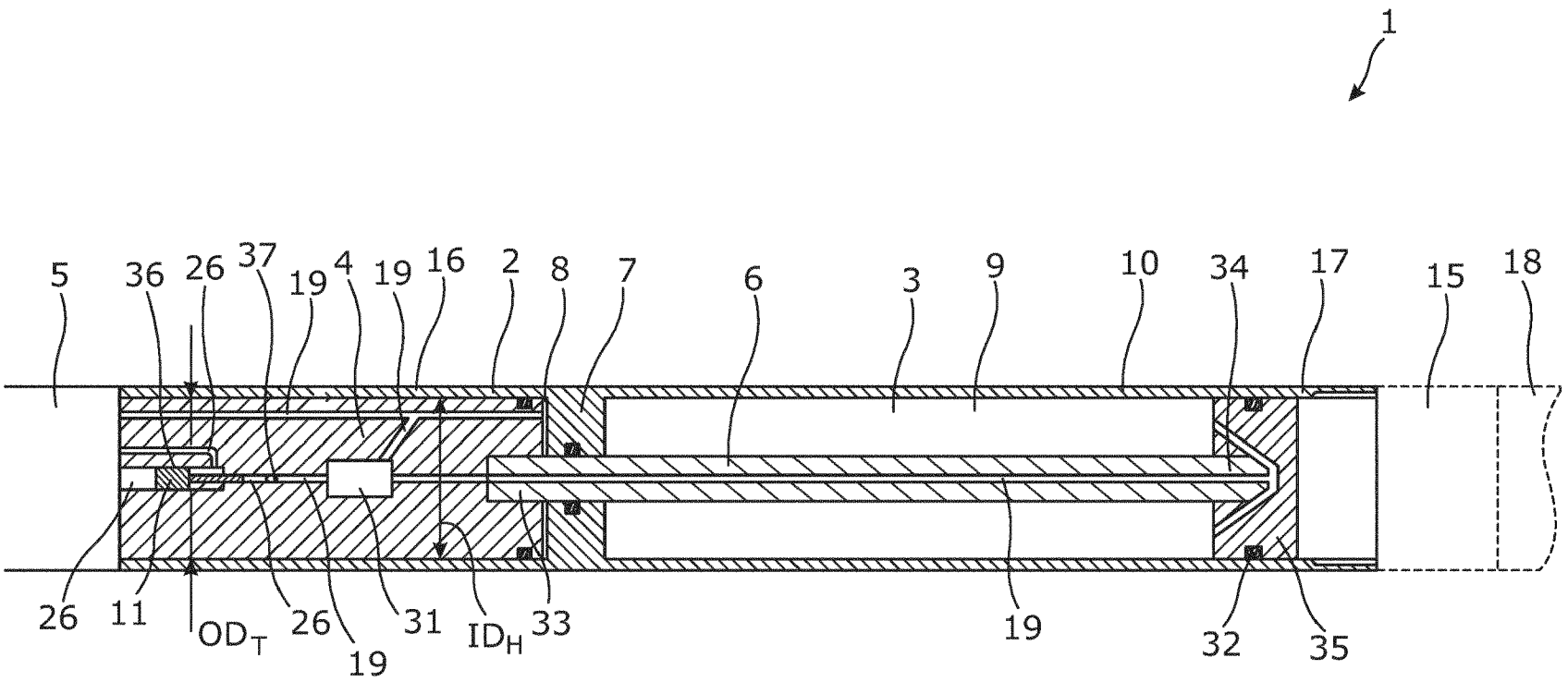
FIG. 4 shows a partly cross-sectional view of another downhole stroking tool having a pressure intensifier.

In FIG. 4, the downhole stroking tool 1 further comprises a pressure intensifier 11 arranged downstream of the pump unit 5 to increase the pressure of the fluid before the fluid is fed to the chamber 3. The pressure intensifier 11 comprises an intensifier piston 36 having one surface area closest to the pump unit 5 which is larger than another surface area closest the chamber 3. The pressure intensifier 11 further comprises fluid channels 26 for providing fluid to and from the pressure intensifier 11, and comprises at least one valve 37.

By having a pressure intensifier, the downhole stroking tool is capable of generating a higher fluid pressure than the pump unit, and thus, the downhole stroking tool is capable of providing a higher axial force than without the pressure intensifier. Due to the restrictions downhole in a well, the size of the pump unit is also restricted.

In FIG. 4, the first tool part 4 has at least one sealing element 32 for providing a seal against the housing 2. The sealing element 32 is arranged in a groove in the first tool part 4 closest to the piston 7 so as to provide a seal even when the housing is moving. A first end 33 of the shaft 6 is fixedly arranged in the first tool part 4, and a second end part 34 of the shaft 6 is fastened in a tool end element 35, the tool end element defining one end of the chamber 3 and the first tool part 4 defining the other end. Another sealing element 32 is arranged in a circumferential groove in the tool end element 35 so as to provide a seal between the sliding housing 2 and the tool end element 35.

In FIG. 4, the tool 1 further comprises a valve block 31 for controlling which chamber section 8, 9 is fed pressurised fluid and thus if the downhole stroking tool 1 provides an upstroke or a downstroke movement.

Figure 5:
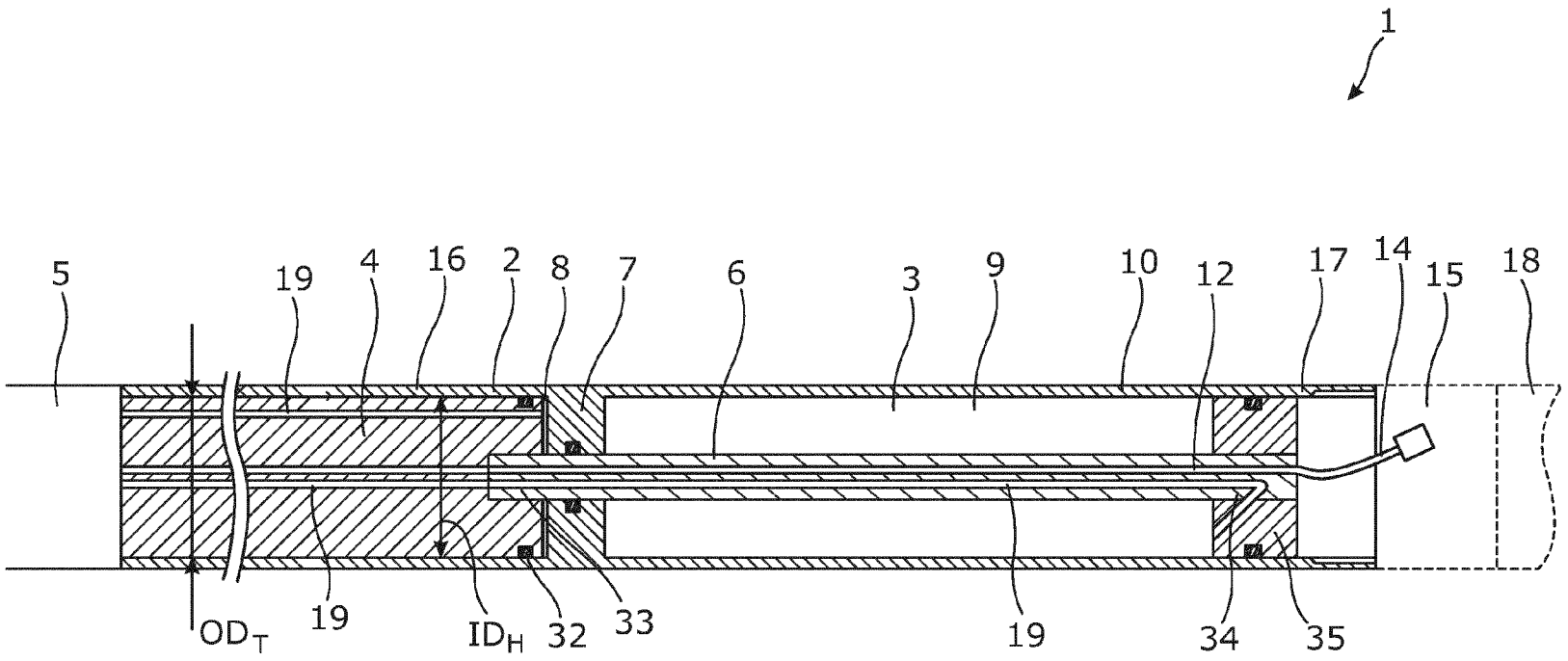
FIG. 5 shows a partly cross-sectional view of the downhole stroking tool having a through-bore for providing electrical power to an operational tool.

In FIG. 5, the shaft 6 has a through-bore 12 in which an electrical conductive means 14 runs through the shaft to provide electric power to e.g. an operational tool 18. The shaft 6 thus comprises both a fluid channel and a through-bore for electrical means. By the shaft 6 being fixed and the housing 2 with the piston 7 sliding, the shaft does not transfer any force and can thus have several through-bores for fluid channels and for electrical wiring. Thus, the operational tool 18 may be electrically powered through the electrical conductive means 14 running through the shaft 6. The operational tool 18 may be a plug connector, a fishing neck, a key tool or a setting tool.

Figure 6:
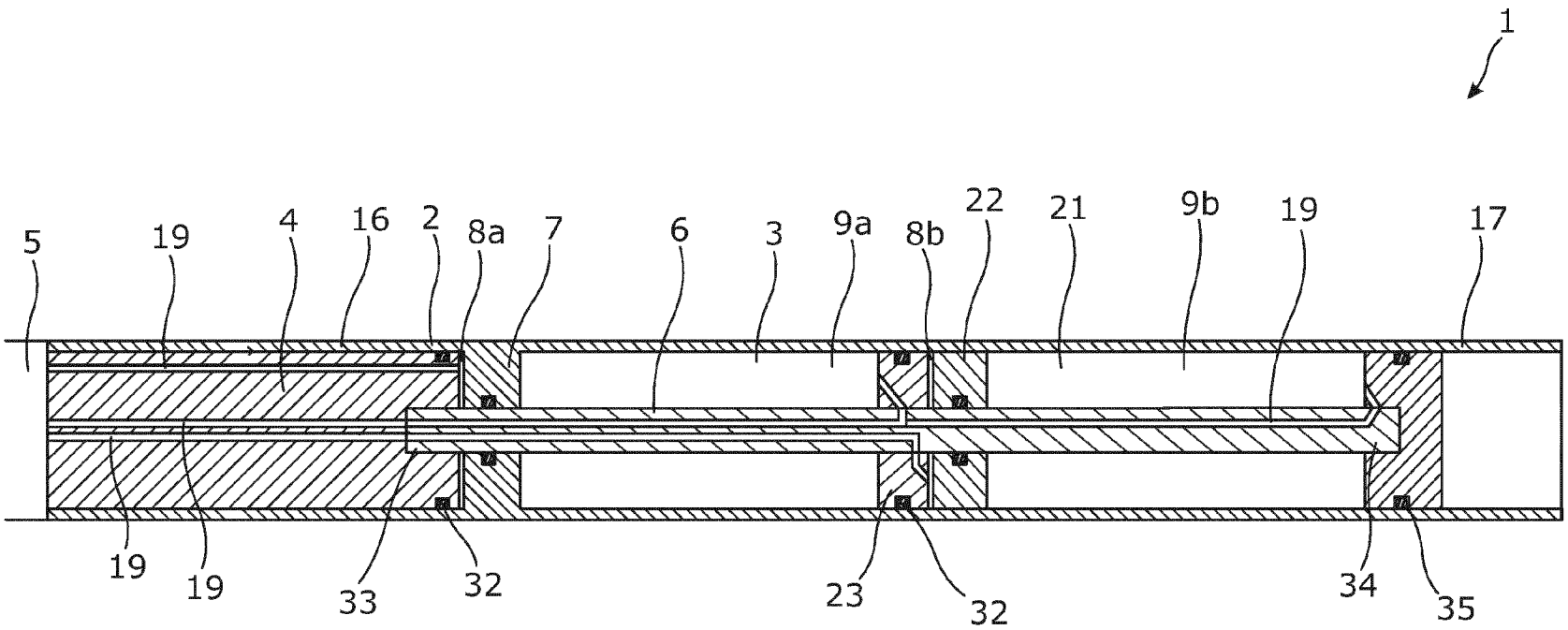
FIG. 6 shows a partly cross-sectional view of the downhole stroking tool having two chambers.

The downhole stroking tool 1 according to FIG. 6 further comprises a second chamber 21 divided by a second piston 22. The second chamber 21 comprises a first chamber section 8*b* and a second chamber section 9*b*. The first chamber section 8*b* and a second chamber section 9*b* of the second chamber 21 have the same configuration as the first chamber section 8*a* and a second chamber section 9*a* of the first chamber 3, as they are divided by a piston. The first and second chambers 3, 21 are both comprised in the housing 2, and both the first piston 7 and the second piston 22 are connected to or form part of the housing 2 and slide along the housing. The shaft 6 comprises an intermediate part 23 separating or dividing the first and the second chamber 3, 21 and forming the ends of both the first and the second chamber. Thus, the first chamber 3 is defined by the first tool part 4, the housing 2, the shaft 6 and the intermediate part 23. The second chamber 21 is defined by the intermediate part 23, the housing 2, the shaft 6 and the tool end element 35. The intermediate part 23 supports the housing 2, also while the housing slides in relation to the intermediate part. As can be seen, the shaft 6 has several fluid channels, one in fluid communication with the second chamber section 9*a* of the first chamber 3 and one in fluid communication with the second chamber section 9*b* of the second chamber 21. A second fluid channel is in fluid communication with the first chamber section 8*b* of the second chamber 21. The fluid communication with the second chamber section 9*b* of the second chamber 21 may be in a separate fluid channel.

Figure 7:
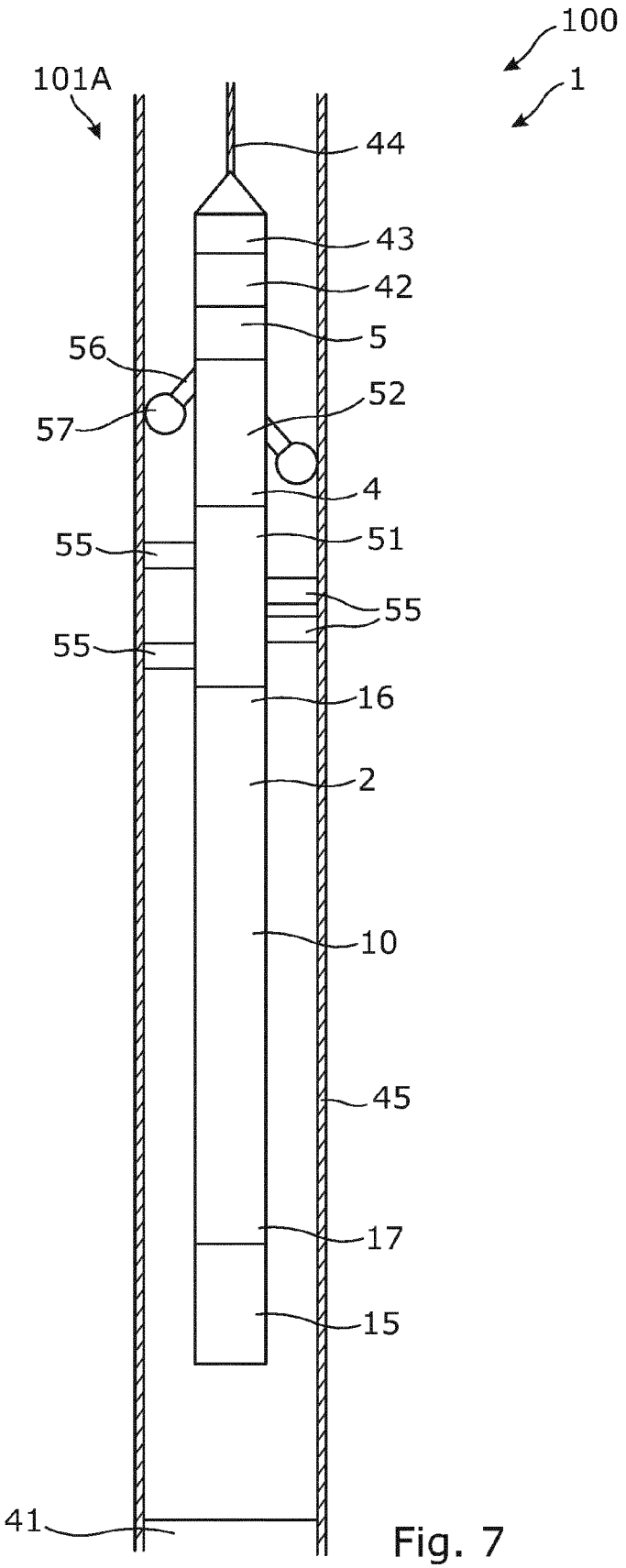
FIG. 7 shows a downhole system having a downhole stroking tool, an anchoring section and a driving unit.

In FIG. 7, the downhole stroking tool 1 further comprises an anchoring section 51 having projectable fixation units 55 for fixating the downhole stroking tool in the casing 45 in the well 101A.

FIG. 7 discloses a downhole system 100 comprising the downhole stroking tool 1 and a driving unit 52, such as a downhole tractor, for propelling the system forward in a well 101A.

Figure 8:
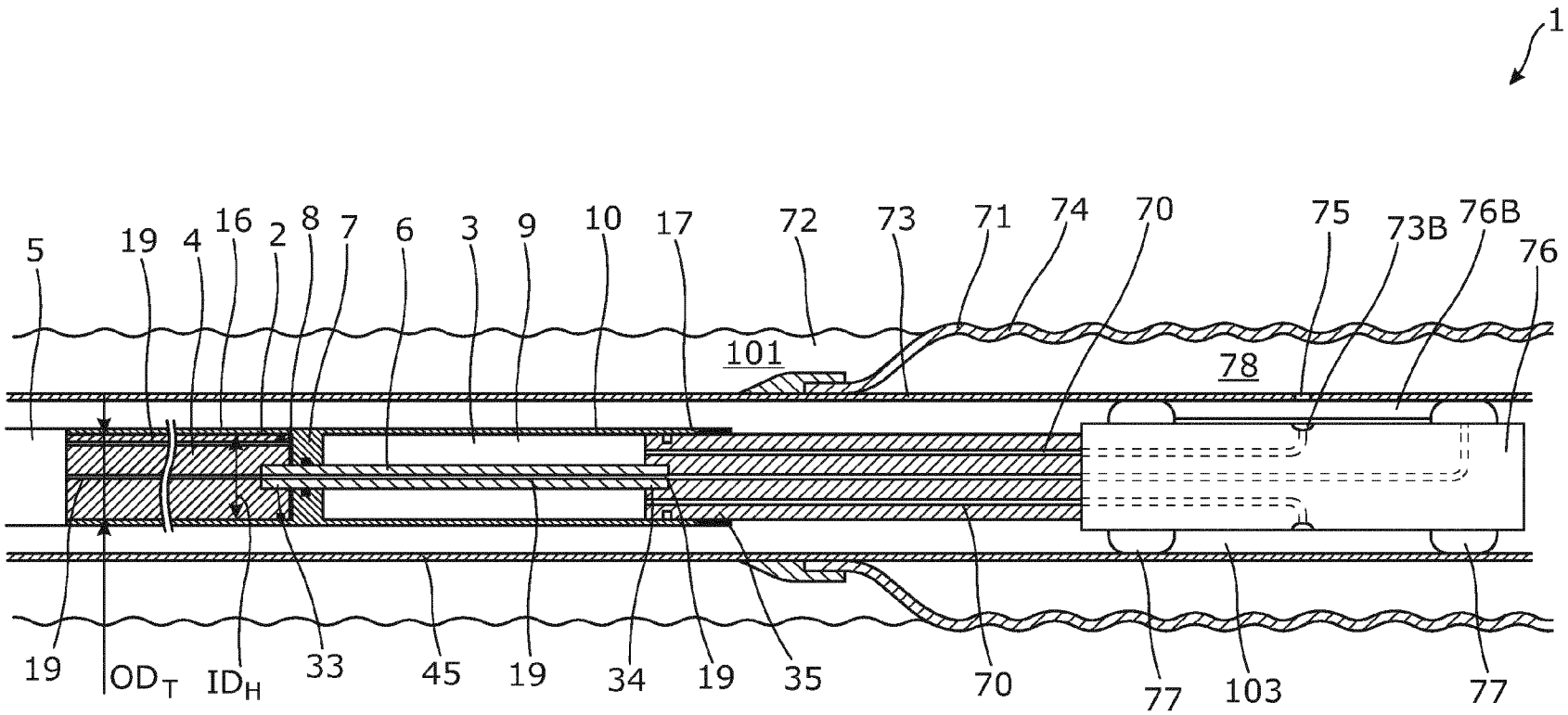
FIG. 8 shows a partly cross-sectional view of a downhole system.

In FIG. 8, the downhole system comprises the downhole stroking tool 1 and a well tubular metal structure 45. The well tubular metal structure 45 comprises an annular barrier 71 which is expanded in an annulus 72 surrounding the well tubular metal structure to isolate a first zone 101 from a second zone (not shown) opposite the annular barrier. The annular barrier 71 comprises a tubular metal part 73 mounted as part of the well tubular metal structure 45, and an expandable metal sleeve 74 connected with the tubular metal part, defining an expandable space 78. The annular barrier 71 comprises an expansion opening 75 through which pressurised fluid enters to expand the expandable metal sleeve. The downhole stroking tool 1 comprises an expansion section 76 having circumferential sealing elements 77 arranged on each side of the expansion opening 75 for isolating an expansion zone 103 opposite the expansion opening. The tool end element 35 connected with the expansion section comprises fluid channels 70 providing fluid communication between the second chamber section 9 and an opening 73B in the isolation section 76B opposite the expansion zone 103. This is to provide pressurised fluid into an expandable space and expand the annular barrier 71. As the piston 7 and the housing 2 move, the fluid in the second chamber section 9 is forced in through the fluid channels 70 in the tool end element 35 and further into the expansion section 76 and into the annular barrier 71 by pressurising the zone 103 opposite the expansion opening 75.

Figure 9:
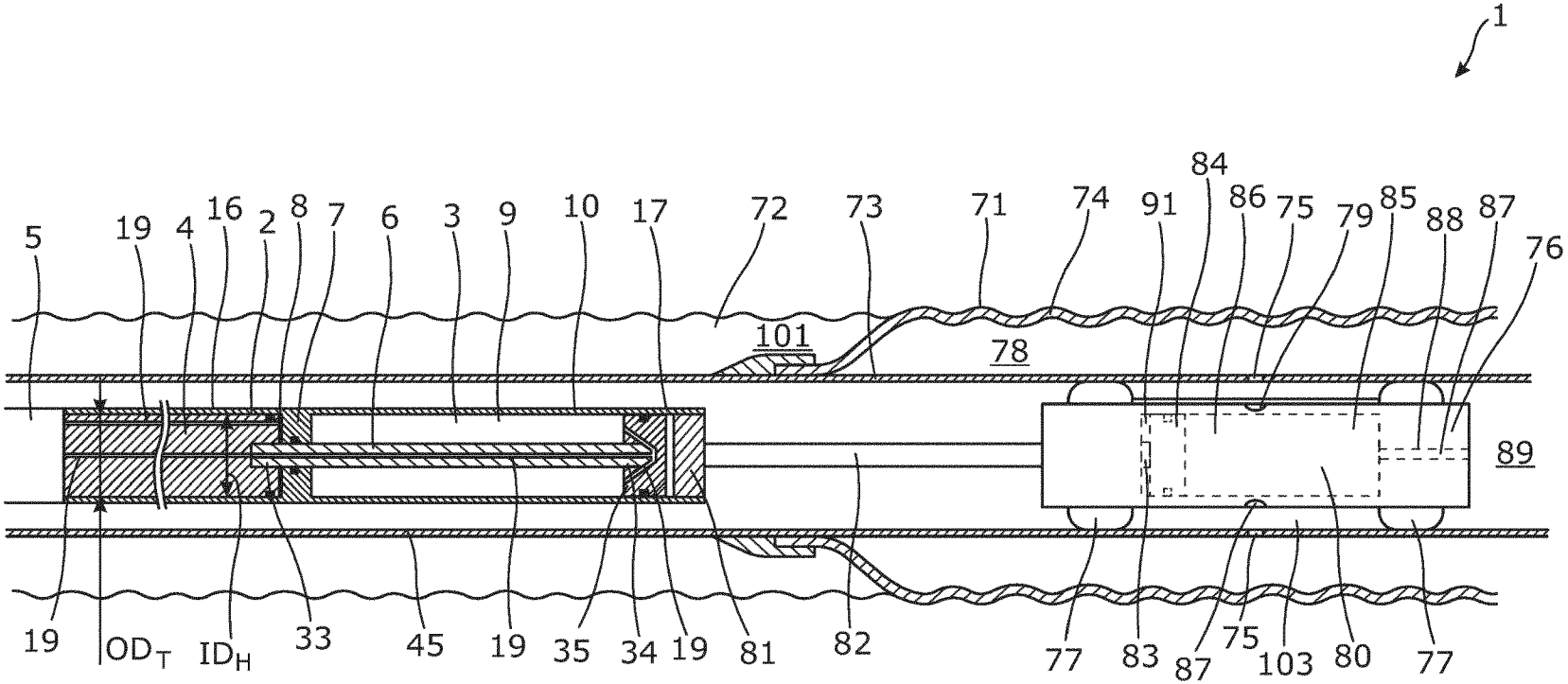
FIG. 9 shows a partly cross-sectional view of another downhole system.

In FIG. 9, the fluid channel 19 in the shaft 6 of the downhole stroking tool 1 is fluidly connected with the sealing elements 77 of the expansion section 76 to expand the sealing elements by means of pressurised fluid from the pump unit 5. Thus, the second tool part 10, the housing 2 and the piston 7 of the downhole stroking tool 1 are connected with a first end 81 of a section shaft 82 of the expansion section 76. A second end 83 of the section shaft 82 is connected to a piston 84 sliding in a section housing 85, dividing a section chamber 80 into a first chamber section 86 in fluid communication with the opening 79 in the expansion section 76 for providing pressurised fluid into the annular barrier and a second chamber section 91. The opening 79 of the expansion section 76 is provided with a one-way valve 87 or a check valve. The first chamber section 86 is fluidly connected with a part of an inside 89 of the well tubular metal structure by means of a second fluid channel 88, which part of the inside of the well tubular metal structure does not form part of the isolated zone. The second fluid channel is provided with a one-way valve 87 or a check valve for taking in fluid from the well tubular metal structure but hindering the fluid from flowing out of the chamber 80. When the tool housing 2 moves the piston 84 of the expansion section 76, fluid inside the first chamber section 86 is forced out of the chamber into the isolated zone 103 and further into the space 78 of the annular barrier 71 to expand the same. Thus, the downhole stroking tool 1 of FIGS. 8 and 9 is used to isolate a zone opposite the annular barrier 71 and expand the expandable metal sleeve 74 of the annular barrier.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing, production casing or well tubular metal structure is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor 52 may have projectable arms 56 having wheels 57, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole stroking tool for providing an axial force in an axial direction, comprising:

a housing, a first chamber, a first tool part comprising a pump unit providing pressurised fluid to the chamber, a shaft penetrating the chamber, and a first piston dividing the first chamber into a first chamber section and a second chamber section, wherein the piston is connected to or forms part of the housing which forms part of a second tool part and is slidable in relation to the shaft so that the housing moves in relation to the shaft, the shaft being stationary in relation to the pump unit during pressurisation of the first or the second chamber section, thereby generating a pressure on the piston, wherein the shaft is fixedly connected with the first tool part, and wherein the housing is slidable in relation to the first tool part and overlaps the first tool part.

2. The downhole stroking tool according to claim 1, wherein the first chamber section and the second chamber section are fluidly connected to the pump unit.

3. The downhole stroking tool according to claim 1, further comprising a pressure intensifier arranged downstream of the pump unit to increase the pressure of a fluid before the fluid is fed to the chamber.

4. The downhole stroking tool according to claim 1, the shaft having a through-bore for allowing an electrical conductor to run through the shaft.

5. The downhole stroking tool according to claim 1, further comprising a connector configured to connect with an operational tool.

6. The downhole stroking tool according to claim 1, wherein the housing comprises a first end part overlapping the first tool part.

7. The downhole stroking tool according to claim 1, further comprising an operational tool connected with the housing.

8. The downhole stroking tool according to claim 7, wherein the operational tool is electrically powered.

9. The downhole stroking tool according to claim 1, wherein the housing has an inner diameter substantially corresponding to an outer diameter of the first tool part.

10. The downhole stroking tool according to claim 1, wherein the shaft and/or the housing comprise(s) one or more fluid channels for providing fluid to and/or from the chamber during pressurisation of the first or the second chamber section, thereby generating a pressure on the piston.

11. The downhole stroking tool according to claim 1, wherein the housing transfers the axial force.

12. The downhole stroking tool according to claim 1, further comprising a second chamber divided by a second piston.

13. The downhole stroking tool according to claim 10, wherein the first and second chambers are comprised in the housing.

14. The downhole stroking tool according to claim 10, wherein the shaft comprises an intermediate part dividing the first and the second chamber.

15. The downhole stroking tool according to claim 1, further comprising an anchoring section having projectable fixation units for fixating the downhole stroking tool in a well.

16. The downhole stroking tool according claim 15, wherein the anchoring section is connected to the first tool part and is configured to anchor the first tool part in a well.

17. The downhole system comprising a downhole stroking tool according to claim 1 and a driving unit, such as a downhole tractor, for propelling the system forward in a well.

18. Use of the downhole stroking tool according to claim 1 for pulling a plug in a well.

* * * * *